US006626134B1

(12) United States Patent
Brinton

(10) Patent No.: US 6,626,134 B1
(45) Date of Patent: Sep. 30, 2003

(54) ENGINE COOLING SYSTEM AND METHOD FOR MAKING SAME

(76) Inventor: Keith A. Brinton, Suite 33, 4375 E. Sahara Ave., Las Vegas, NV (US) 89104

( * ) Notice: Subject to any disclaimer, the term of this patent is extended or adjusted under 35 U.S.C. 154(b) by 0 days.

(21) Appl. No.: 10/049,244

(22) PCT Filed: Jul. 27, 2000

(86) PCT No.: PCT/US00/20535

§ 371 (c)(1),
(2), (4) Date: Jun. 3, 2002

(87) PCT Pub. No.: WO01/07771

PCT Pub. Date: Feb. 1, 2001

Related U.S. Application Data

(63) Continuation of application No. 09/361,325, filed on Jul. 27, 1999, now abandoned.

(51) Int. Cl.[7] ..... F28F 1/36
(52) U.S. Cl. ..... 123/41.56; 123/41.69
(58) Field of Search ..... 123/41.69, 41.56; 165/80.3, 181, 179

(56) References Cited

U.S. PATENT DOCUMENTS

| | | | | | |
|---|---|---|---|---|---|
| 2,398,216 | A | * | 4/1946 | Francisco, Jr. | 123/41.69 |
| 2,771,277 | A | * | 11/1956 | Cross | 123/41.69 |
| 3,782,342 | A | * | 1/1974 | Schier | 123/41.69 |
| 4,007,773 | A | * | 2/1977 | McCormick | 123/41.69 |
| 4,170,260 | A | * | 10/1979 | Rudd et al. | 123/41.69 |
| 5,240,070 | A | * | 8/1993 | Ryan | 165/181 |
| 5,259,448 | A | * | 11/1993 | Masukawa et al. | 165/179 |
| 5,421,292 | A | * | 6/1995 | Hoffman et al. | 123/41.69 |
| 5,996,686 | A | * | 12/1999 | Thors et al. | 165/179 |
| 6,098,420 | A | * | 8/2000 | Furukawa et al. | 165/179 |
| 6,173,762 | B1 | * | 1/2001 | Ishida et al. | 165/181 |

OTHER PUBLICATIONS

PCT International Search Report, PCT/US00/20535, dated Oct. 3, 2000.

PCT Written Opinion, PCT/US00/20535, dated Jul. 27, 1999.

Printed copy of yourMachinist website, URL http://www.yourmachinist.com/, printed Feb. 20, 2003.

* cited by examiner

*Primary Examiner*—Henry C. Yuen
*Assistant Examiner*—Jason Benton
(74) *Attorney, Agent, or Firm*—TraskBritt

(57) ABSTRACT

Engine cooling system and method for making same wherein an engine, engine casing, or component thereof or a component related thereto has at least one cooling fin (18) having at least a portion of an edge surface (32) including an engraved, or intagliated portion (40). Preferably the surface edge includes a plurality of intagliated portions (40) with each portion including at least two elongated concavities being in preselected orientation and relationship to each other to improve the cooling efficiency of the fin and thus allow the engine to operate in wider, more extreme range of temperature and environments. The present invention is particularly well suited, but not limited to air-cooled engines and related components such as component covers, inspection/access covers, and oil coolers and is therefore readily adaptable to engines used to propel motor vehicles such as, but not limited to, motorcycles.

14 Claims, 16 Drawing Sheets

ENGINE COOLING SYSTEM AND METHOD FOR MAKING SAME

This application is a continuation of Ser. No. 09/361,325 filed Jul. 27, 1999 now abandoned.

TECHNICAL FIELD

The present invention relates generally to engines, including but not limited to internal combustion engines used, for example, as source of power in propelling motorized vehicles. Specifically, the invention is directed to a cooling system for engines and components thereof as well as methods for producing the system.

BACKGROUND

Engines, especially internal combustion engines, produce significant amounts of heat during the course of their operation. Continued operation of an engine requires that the heat produced during its operation be transferred away from the engine at a high rate. This is especially true in with engines installed in vehicles which are operated at elevated ambient temperatures and higher elevations, or altitude. Another important factor is the availability of a cooling airstream or the lack thereof. To this end, engines are fitted with various cooling systems for transferring heat away from the engine. These cooling systems typically rely on a flow of fluid over or through the engine casing or engine components as a means of transferring heat from the engine to the environment. Failure to transfer heat away from the engine can result in a significantly reduced power output of the engine and in extreme conditions could lead to failure of the engine.

Many engines rely on air as the primary cooling agent and thus such engines are often referred to as being "air-cooled" engines. Such air-cooled engines are, for example, used extensively to power motorcycles, snowmobiles, light aircraft, and other vehicles where the weight and added complexity of a liquid-cooled engine is not desired or feasible. Air-cooled engines are also used extensively for engine powered lawn mowers as well as for engine powered gardening, construction, and wood sawing equipment.

In contrast, a liquid cooled engine will typically have a liquid such as water, ethanol, or other liquid which is circulated within internal passageways, or jackets, of the engine to remove heat generated by the engine. A liquid coolant circulative system can be either a closed system, such as radiator cooling system in an automobile which continuously recirculates a relatively small quantity of cooling fluid or an open system, such as a cooling system for boat engines which draw water in from the water in which the boat is operating and then merely discharge the water overboard after it has been passed through the boat engine.

Whether the engine is primarily air-cooled or primarily liquid- cooled, the engine will typically, but not always, consist of an engine casing, at least one cylinder or barrel structure encasing at least one reciprocating piston and a cylinder head. The cylinder head is mounted atop the cylinder and provides a combustion chamber as well as for housing intake and exhaust valve mechanisms if the engine is an "overhead valve" type of engine. If the engine is an "overhead cam" type of engine, the cylinder head will typically house at least one camshaft in addition to the valve train, or mechanism, in which the camshaft is an operative component. Additionally, an engine will often include a valve cover, if an overhead valve type of engine, or alternatively a cam cover if the engine is an overhead cam type of engine. There are of course other types and variations of the four-stroke type of engines just described, as well as other types of engines. One such engine is a two-stroke type of engine, which will typically include an engine casing, at least one cylinder encasing a reciprocating piston, and cylinder head having a combustion chamber. Unlike a four-stroke type of engine, the cylinder head of a two-stroke engine will normally not have any type of valve train or cam operated mechanism in the cylinder head itself.

Regardless of the specific type of air-cooled engine and regardless of how many cylinders, or how each cylinder is physically oriented with respect to another cylinder, i.e. inline, opposed, or whether in a V-arrangement, the engine is usually positioned to permit a flow of air over and about the engine, including at least some if not all of the previously mentioned sub-components of the engine during the operation of the engine.

To increase the rate of heat transfer to the ambient air generated by the combustion of fuel and air within the engine, or more precisely the heat generated within the cylinder and the cylinder head where such combustion takes place, at least the cylinder, or cylinders in a multi-cylinder engine, and the respective cylinder head, or cylinder heads, the engine is often fitted with a number of cooling fins which extend outwardly from the engine. Such cooling fins are usually extensively provided on the cylinder structure and cylinder head portions of an air-cooled engine, and often to a lesser extent on liquid-cooled engine as well in order to transfer heat away from the engine which is generated by the combustion of fuel and air. To provide additional cooling capability, it is not uncommon to provide cooling fins on the engine casing as well as on the valve covers, or cam covers, other sub-components and auxiliary components of the engine to enhance the transfer of heat generated by the engine to the surrounding environment which is usually the ambient air, but which could be another fluid as the term is used in the field of engineering. It is widely recognized within the art of constructing engines which employ cooling fins, that cooling fins serve to increase the effective surface area from which heat is transferred to the environment generated from within the engine and its associated components. With the increase in effective surface area provided by the cooling fins, the rate of radiative and convective heat transfer to the environment is increased. Such increase in cooling capability is further influenced by the number and size of the cooling fins which have been placed on various engine components to help better regulate the air exchange to produce a sought after cooling effect for the intended range of operation and conditions in which the engine will be subjected.

Although the art is replete with internal combustion engines having a wide variety of cooling fin arrangements, there remains a need within the art to provide a yet more efficient system of heat transfer from engines. Additionally, there is a need to provide a more efficient system of heat transfer from engines which is readily adaptable to air-cooled, liquid-cooled, four-stroke type, two-stroke type, or other type of engine and which is readily adaptable to any particular application in which a given engine is to be used, whether it be a motorcycle, aircraft, boat, or other motorized vehicle, and which is generally suitable for use with transferring heat energy generated from the operation of an engine.

There also remains a need with the art for an engine cooling system and method for making same that can be readily incorporated within the design of newly manufactured engines and related components or which can readily be retrofitted onto any engine and related components having cooling fins.

Furthermore, there is a need within the art for an engine cooling system and method for making same that is particularly suitable for incorporation within particular components of engines having at least one cooling fin, or similar structure thereon. Such engine components include, but are not limited to, engine casings, cylinders, cylinder heads, various inspection/access covers, valve, or rocker-arm, covers, cam covers, and other components which form, are attached, or otherwise associated with an engine.

There is also a need within the art for an engine cooling system and method for making same that is particularly suitable for incorporation within auxiliary components of engines, including but not limited to, heat exchangers such as oil coolers and liquid coolant radiators, and other components which may not necessarily be directly attached or directly form a portion of an engine.

DISCLOSURE OF INVENTION

The present invention provides an engine cooling system which provides an unexpected, measurably increased rate of transfer of heat from an engine or a component thereof to the ambient environment. The present invention is particularly suitable for use in connection with any engine or component thereof which includes a finned structure thereon having a first surface, a second surface, and a peripheral, or outermost, edge surface in communication with the first and second surfaces and thus is especially suitable for use in connection with, but not limited to, air-cooled internal combustion engines.

In contrast to conventional cooling fins of an engine, or a component thereof, the cooling system of the present invention includes at least a portion of at least one edge of a fin being provided with at least one, and preferably a plurality of pre-selectively configured concavities, or incisive voids, so as to form an intaglio to enable the fin to transfer heat to the environment more efficiently and thus provide an enhanced cooling effect as compared to conventional cooling fins. The present invention, in a preferred embodiment, comprises engraving at least the edge surface of a fin of an engine, or component thereof, with a rotatable engraving tool, or cutting tool, to provide a plurality of pre-selectively configured concavities preferably arranged in preselected, repeating pattern.

In accordance with one embodiment of the present invention, at least an engine casing, a cylinder, a cylinder head, a cover, or other component of an engine having at least one fin-like structure comprises the at least one fin-like structure having a peripheral edge portion thereof engraved, incised, or otherwise formed in the nature of a intaglio, so as to display a plurality of elongated concavities arranged and oriented in a preselected, repeating pattern. Preferably the elongated concavities are angled with respect to the horizontal, or major, axis of the fin with at least a first row of elongated concavities being positioned generally vertically above at least a second row of elongated concavities.

In accordance with one embodiment of the present invention, an auxiliary component of the engine such as an oil cooler, a radiator, or other auxiliary component whether mounted directly or mounted remotely from the engine, is provided with at least one fin extending generally outward from the component and comprises the at least one fin having a peripheral, or outer, edge portion thereof engraved, incised, or otherwise formed in the nature of an intaglio, so as to display a plurality of elongated concavities arranged and oriented in a preselected, repeating pattern. Preferably the elongated concavities provided on at least a portion of the edge of the fin are angled with respect to the horizontal axis of the fin with at least a first row of elongated concavities being positioned generally vertically above at least a second row of elongated concavities.

Other advantages and benefits of the present invention will become apparent to those of ordinary skill in the pertinent art upon viewing the appended drawings and reviewing the following detailed description of the present invention.

BEST MODES FOR CARRYING OUT THE INVENTION

Figure 1:
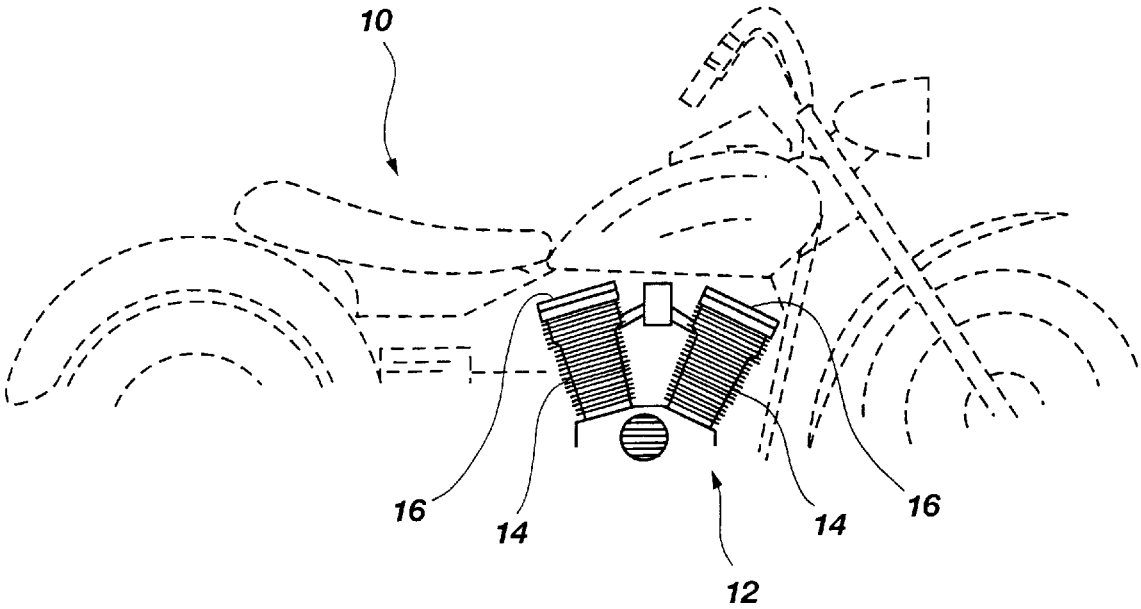
FIG. 1 is a side view of a representative motorcycle (shown in phantom) having an engine mounted therewithin and wherein the engine includes cylinders, cylinder heads, rocker-arm covers, and an inspection cover.

Referring first to FIG. 1, a motorcycle 10 is shown in phantom includes an engine 12 mounted therein. Engine 12 is depicted as a V-twin engine in that it includes two cylinders 14 opposed at a preselected angle or "V". Engine 12 further includes a cylinder head 24 mounted atop each cylinder 14 and mounted atop each cylinder head is a rocker, or valve, cover 16. It is to be understood that the V-twin engine shown in FIG. 1 is merely exemplary and the present invention is not limited to any particular type of engine, such as a four-stroke or two-stroke type of engine, or an engine having a certain number of cylinders, cylinder heads, or rocker covers. It is to be further understood that the present invention is readily adaptable to any engine, whether air-cooled or liquid cooled, and is not limited to only motorcycle applications.

Figure 2:
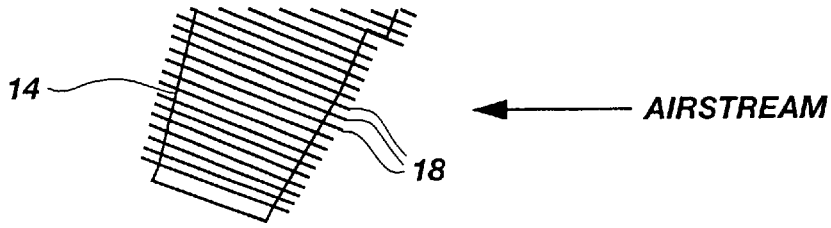
FIG. 2 is a partial side view of a cylinder having a plurality of cooling fins extending generally outwardly from the cylinder and being exposed to an airstream.

Referring now to FIG. 2, a cylinder 14 is shown in more detail, including the plurality of cooling fins 18 extending outwardly from cylinder 14. Cylinder 14, as well as other components, are generally made from material comprising aluminum, or an aluminum based alloy, iron, steel, or another suitable material. FIG. 2 further illustrates a stream of air impinging upon cylinder 18 as is typical when the vehicle in which engine 12 is mounted is in motion. The plate like cooling fins 18 are illustrated as essentially extending outwardly from the entire length of cylinder 18 to, in effect, enlarge the overall surface area of cylinder 18 to promote efficient heat transfer from each cooling fin to the surrounding ambient air.

Figure 3:
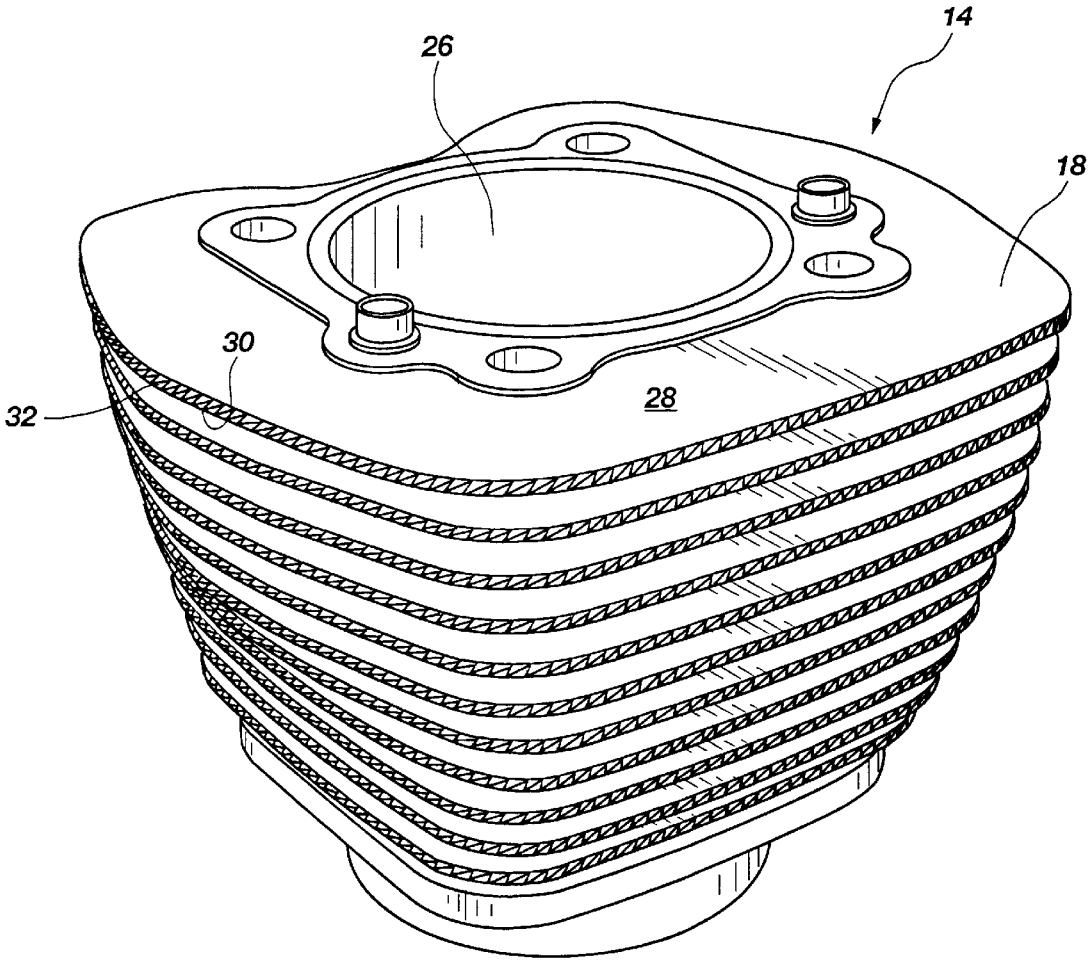
FIG. 3 is a perspective view of the cylinder shown in FIG. 2.

FIG. 3 is a perspective view showing in more detail exemplary cylinder 14. Cylinder 14 includes a plurality of cooling fins 18 which are shown to be in essentially a vertically stacked arrangement wherein each cooling fin is generally parallel to the cooling fin or fins located proximate thereto. It should be understood that cooling fins can and often are configured, positioned, and oriented with respect to each other in a wide variety of manners, styles, and arrangements As shown in FIG. 3, each cooling fin 18 is comprised of a first surface 28, a second oppositely facing surface 30, and a peripheral edge surface 32 located at the outermost periphery of cooling fin 18. Thus, edge surface 30 will typically be in communication with the first and second surface. Edge surface 32 is shown as having significant irregularities, or undulations, which are in sharp contrast to the generally smooth and planar edge surfaces of conventional cooling fins. Bore 26 extends longitudinally through cylinder 14 and accommodates a reciprocating piston, not shown, as is well understood within the art.

Figure 4:
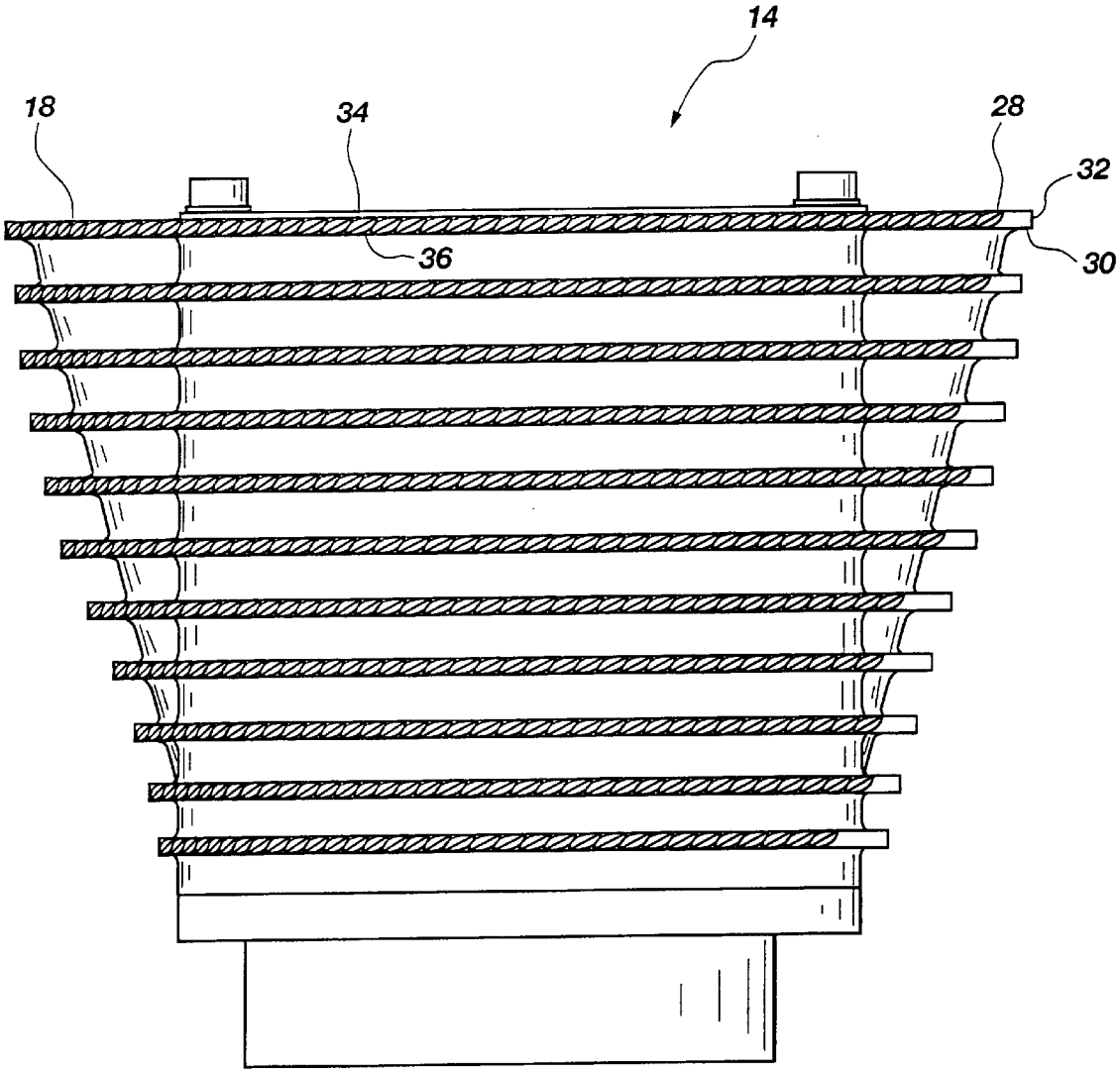
FIG. 4 is a side view of the cylinder shown in FIG. 3.

FIG. 4, which is a side view of cylinder 14 depicts, with a higher level of detail, edge surface 32 of cooling fins 18 being provided in accordance with a preferred embodiment of the present invention, an edge surface having been engraved, ground, or formed so as to result in edge surface 32 to exhibit a repeating pattern of elongated concavities in the nature of an intaglio. Such a surface edge promotes an increased amount of heat transfer from the cooling fin to the ambient air, which is often moving in relation to cylinder 14 when engine 12 is being operated.

Figure 5:
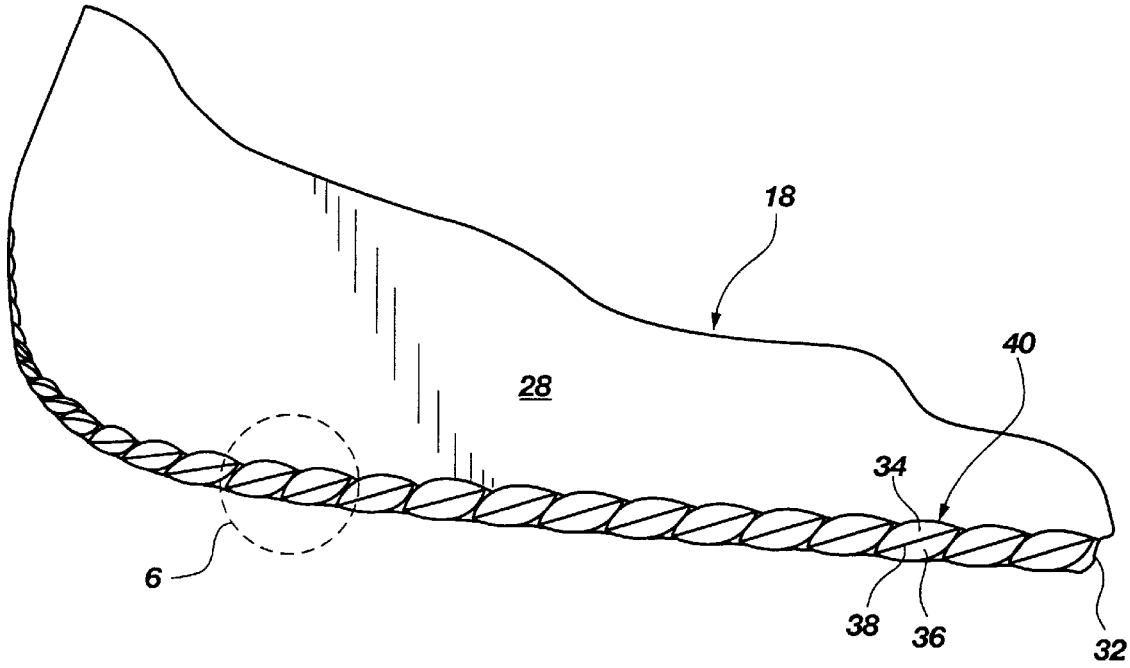
FIG. 5 is an upper perspective view of a representative portion of a cooling fin.

FIG. 5, provides a perspective view of an isolated portion of cooling fin 18 showing in even more detail individually engraved and abutting positioned intaglio portions 40 of edge surface 32, with each intaglio portion 40 preferably comprising an upper elongated concavity 34, a lower elongated concavity 36, and a deepest most syncline, or intaglination, 38 positioned intermediate upper elongated concavity 34 and lower elongated concavity 36.

Figure 6:
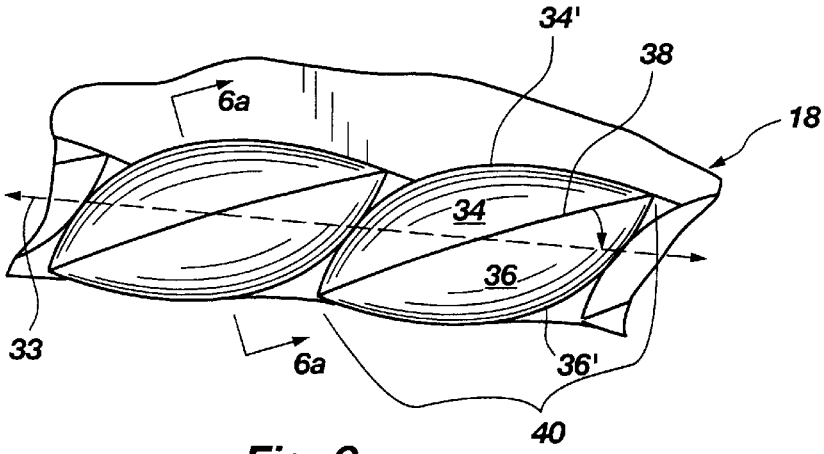
FIG. 6 is an enlarged, isolated view taken as depicted in FIG. 5.
Figure 6A:
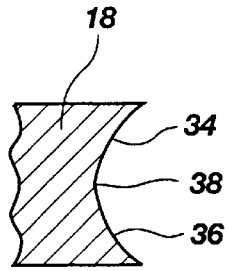
FIG. 6*a* is cross-sectional view taken as shown in FIG. 6.

FIG. 6 provides a yet further enlarged, or magnified view of the representative portion of a cooling fin as denoted in FIG. 5. As can be seen in FIG. 6, portions 40 of edge 32 are generally symmetrical with syncline, or intaglination, 38 being the deepestmost region of portion 40. The outer boundary 34' of elongated concavity 34 and the outer boundary 36' of elongated concavity 36, are generally the shallowmost regions of intagliated portion 40. Thus, intagliated portion 40 curves inwardly and toward intermediately positioned line 38 to form an upper row of elongated concavities 34 and a lower row of elongated concavities 36 when a plurality of individual portions 40 are positioned laterally and proximate to each other. Preferably, intagliated portions 40 are positioned laterally contiguous to each other as shown, to form a plurality of footballesque impressions, incisions, voids, or intagliations which extend essentially over the entirety of edge surface 32. The cross-sectional view of a representative portion of intagliated portion 40 is shown in FIG.6a which shows the general nature of how intagliated portion 40 is recessed inwardly from edge surface 32 and thus into fin 18.

Figure 7:
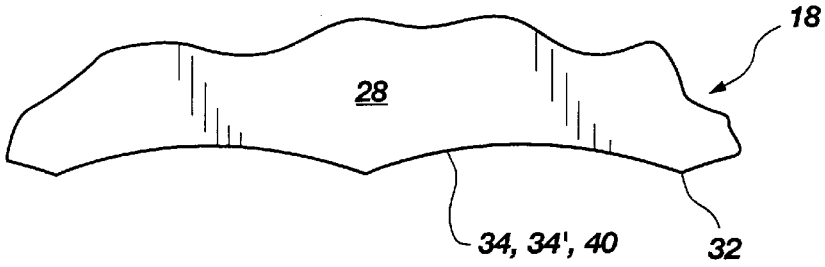
FIG. 7 is a top view of the enlarged, isolated view as depicted in FIG. 5.

Referring to FIG. 7, which shows a top view of the enlarged portion of cooling fin 18 shown in FIG. 6. The top view of FIG. 7 shows the "scalloped" geometry of upper elongated concavity 34 and in particular shows the scalloped contour of outerboundary 34' on edge surface 34 and fin surface 28. Essentially the same image shown in FIG. 7 would be accurate if one were to view the opposite side of fin 18 so that surface 30 of fin 18 would be viewable and the scalloped contour of lower elongated concavity 36 and outer boundary 36' would be viewable.

Figure 8:
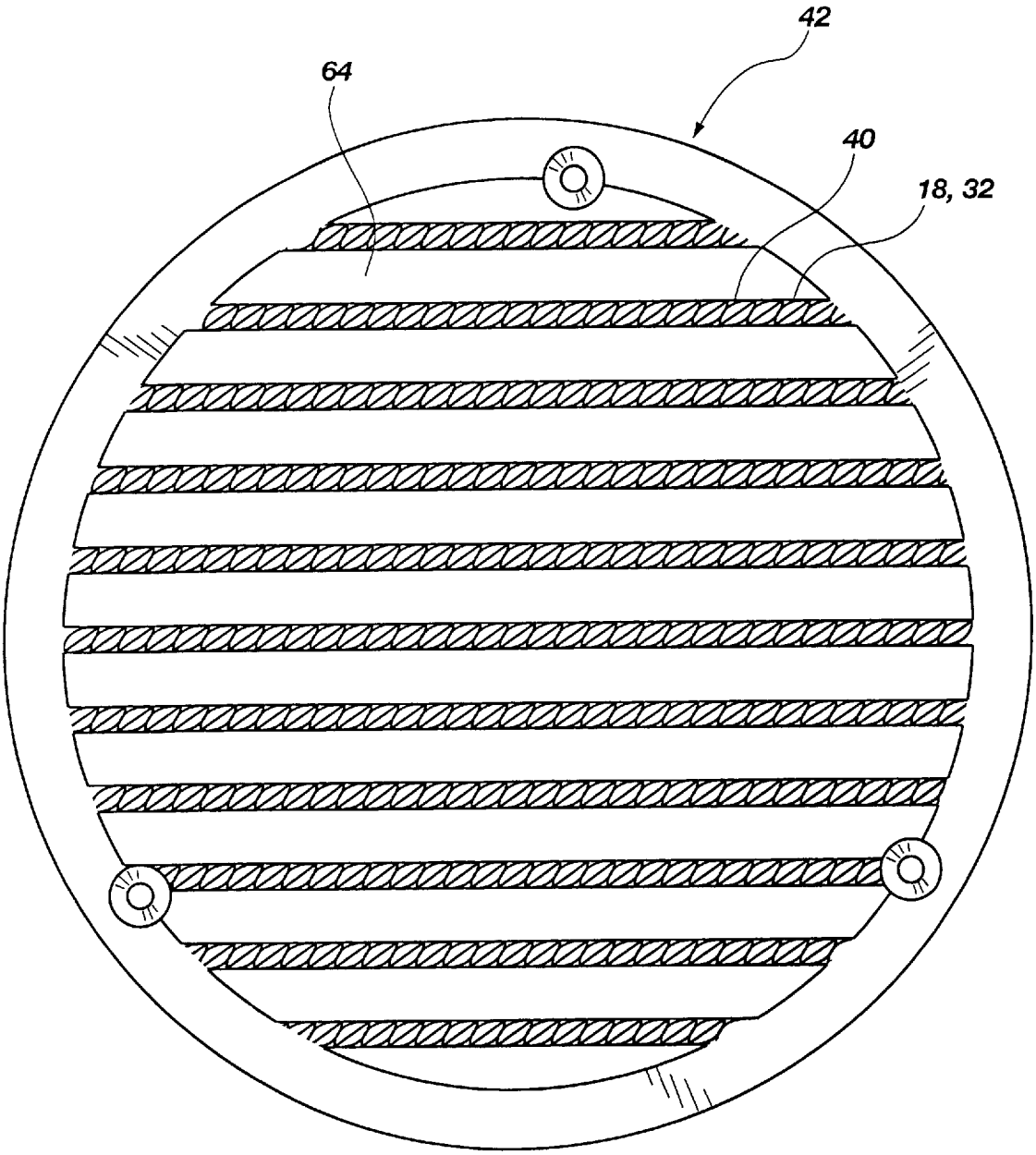
FIG. 8 is front view of a representative circular-shaped inspection cover.

Referring now to FIG. 8 of the drawings, which depicts the exterior of a circular-shaped inspection cover 42, typically located on engine casings, primary drive casings, and/or transmission casings, which is sometimes referred to as a "derby" cover when used in connection with providing access to a clutch mechanism of a primary drive casing of an engine. Exemplary inspection cover 42 as shown in FIG. 8 includes a plurality of cooling fins 18 separated by recessed channels 64. Cooling fins 18 are shown as having edge surface 32 being provided with intaglio portions 40 in accordance with the preferred embodiment of the present invention as described with respect to cooling fins 18 of cylinder 14. Of course inspection cover 42 can readily incorporate alternative embodiments and variations of the present invention in lieu of, or in combination with, the preferred embodiment shown.

Figure 9:
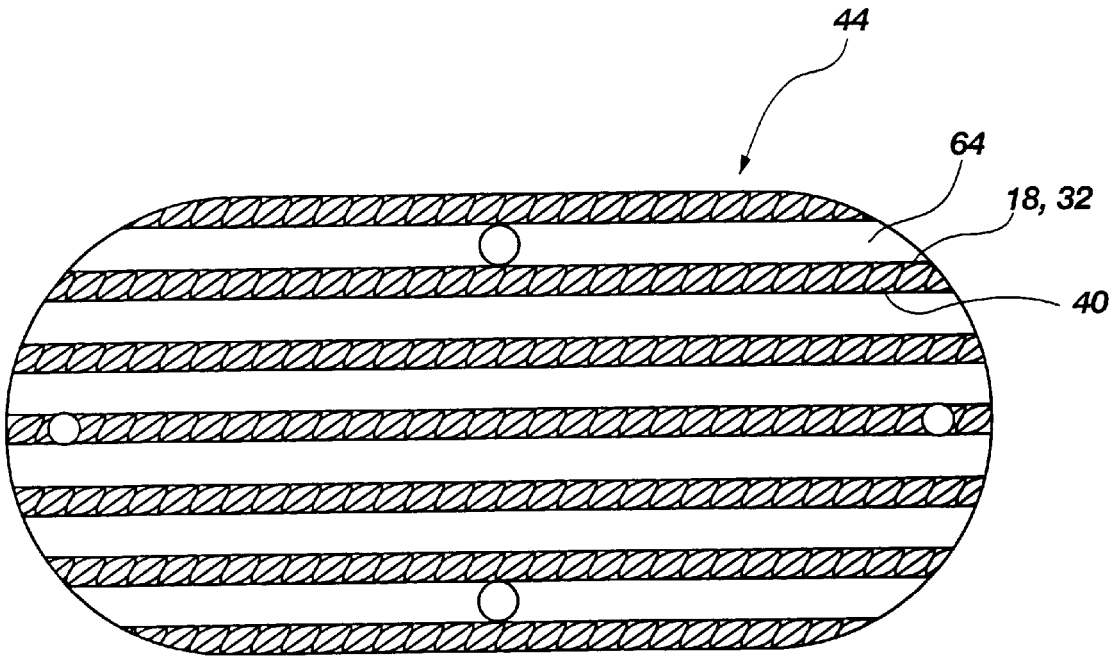
FIG. 9 is a front view of a representative oval-shaped inspection cover.

FIG. 9 of the drawings depicts an oblong shaped inspection cover 44, having cooling fins 18 separated by recessed channels 64. Inspection cover 44 is provided with intagliated portions 40 in accordance with the preferred embodiment of the present invention. Oblong shaped inspection cover 44 happens to be particularly suitable for, but not limited to, providing access to a primary drive chain located within a primary drive casing of an engine. As with inspection cover 42 shown in FIG. 8, inspection cover 44 is perfectly suitable for incorporating and benefitting from alternative embodiments and variations of the present invention in addition to or in lieu of the preferred embodiment.

The inspection covers shown in FIGS. 8 and 9 are merely exemplary and the present invention of providing cooling fins having at least one edge surface having at least a portion, if not the entire edge surface, or edge surfaces, to include an engraved, or intagliated, portion or portions to improve the cooling characteristics of engine components, including inspection covers fabricated from a wide variety of suitable materials, thickness, geometrical shapes, and contours is within the scope of the present invention.

Figure 10:
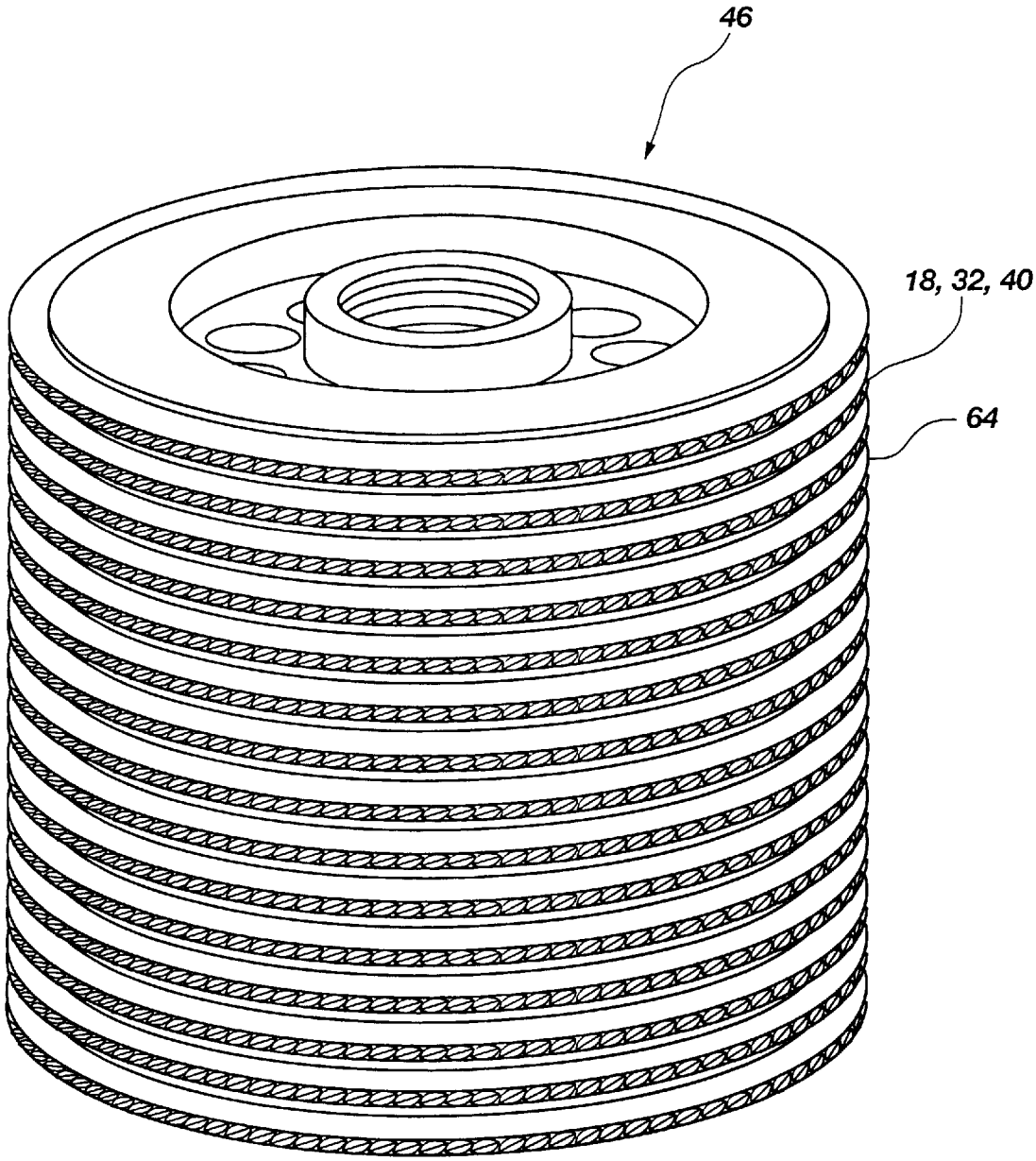
FIG. 10 is a perspective view of a representative cylindrically-shaped oil cooler.
Figure 11:
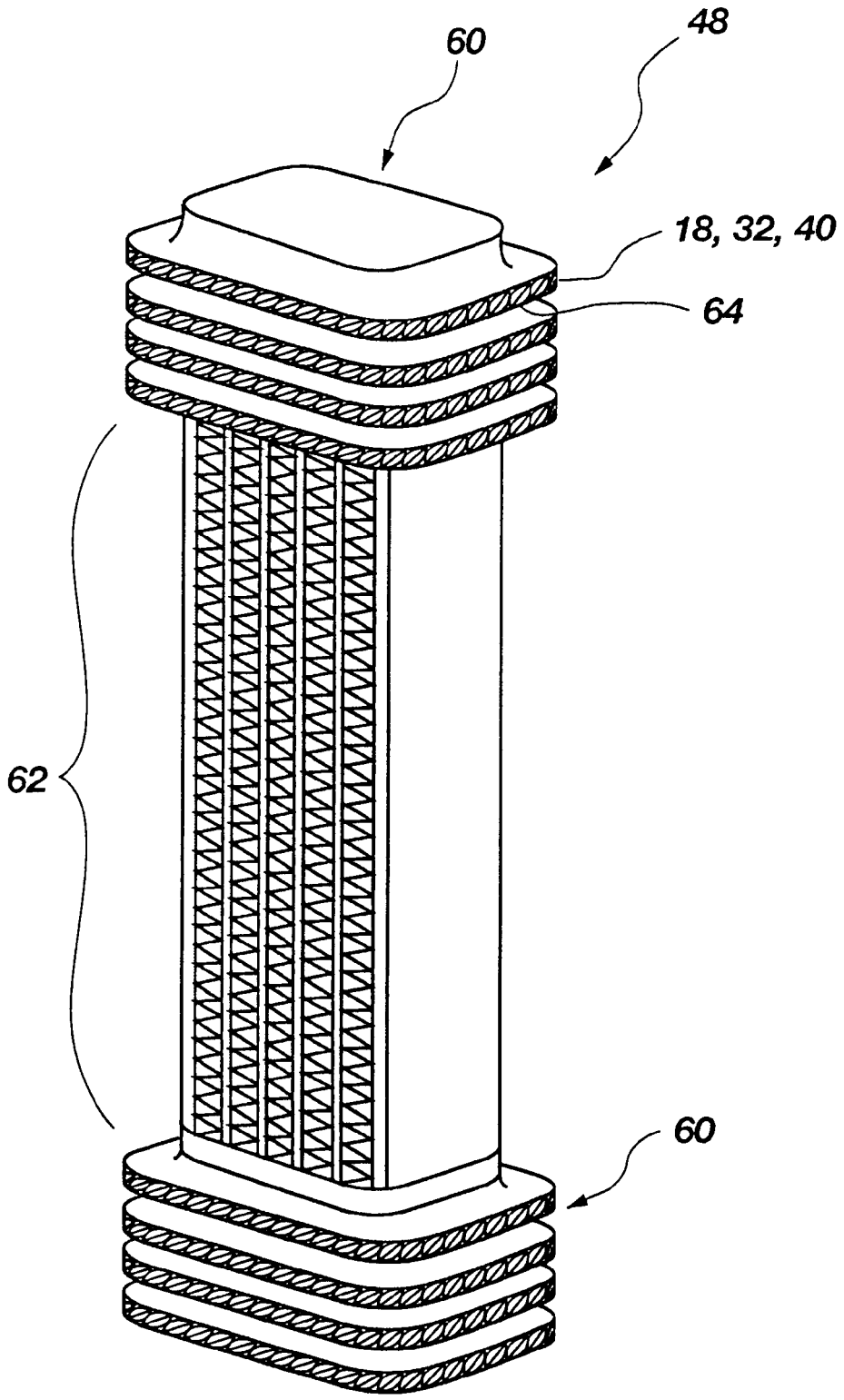
FIG. 11 is a perspective view of a representative rectangular-shaped oil cooler.

The present invention may further be readily adapted to other engine related components such as the exemplary oil coolers shown in FIGS. 10 and 11 of the drawings to enhance the cooling characteristics thereof. Cylindrically shaped oil cooler 46 is preferably provided with a plurality of cooling fins 18 separated by recessed channels 64. Cooling fins 18 include at least one edge surface 32 comprising intagliated portions 40 on at least a portion, if not essentially the entirety of edge surface 32 in accordance with the present invention. Cylindrically shaped oil cooler 46 typically has one end mounted directly to an engine casing. Additionally an oil filter is attached to the opposite end of the oil cooler so that oil passing through cooler 46 to the attached filter, not shown, will be cooled before the oil eventually returns to the engine casing via cooler 46 after being filtered.

Rectangular shaped oil cooler 48 depicted in FIG. 11, is shown as having opposing end portions 60 having cooling fins 18 protruding therefrom. Cooling fins 18 are also typically separated by recessed channels 64. Intermediate opposing end portions 60 is oil cooler body, or core, 62 which typically employs conventional multipass heat exchanger tubes having undulating cooling fins positioned between each tube. In a more general sense, oil cooler 48 can be regarded as a shell and tube type heat exchanger known within the art. Oil heated from an engine, such as engine 12 is routed to oil cooler 48 and upon making at least one, and typically several passes through the cooler, the oil, now at a reduced temperature, is returned either directly to the engine or to an oil reservoir whereupon it is eventually returned directly to the engine. In accordance with the present invention, surface edge 32 of cooling fins 18 of at least end portions 60, and optionally core, or body, 62 are provided with intagliated portions 40 to improve the cooling characteristics of cooler 48.

It should be understood and appreciated that oil coolers 46 and 48 are merely exemplary of engine related components which the present invention may be readily adapted, or incorporated within, and serve to demonstrate that the present invention may be used with various oil coolers, radiators, and heat exchangers that are used within the art in connection with cooling various fluids that are used to lubricate, cool, or aid the cooling of engines.

Figure 12:
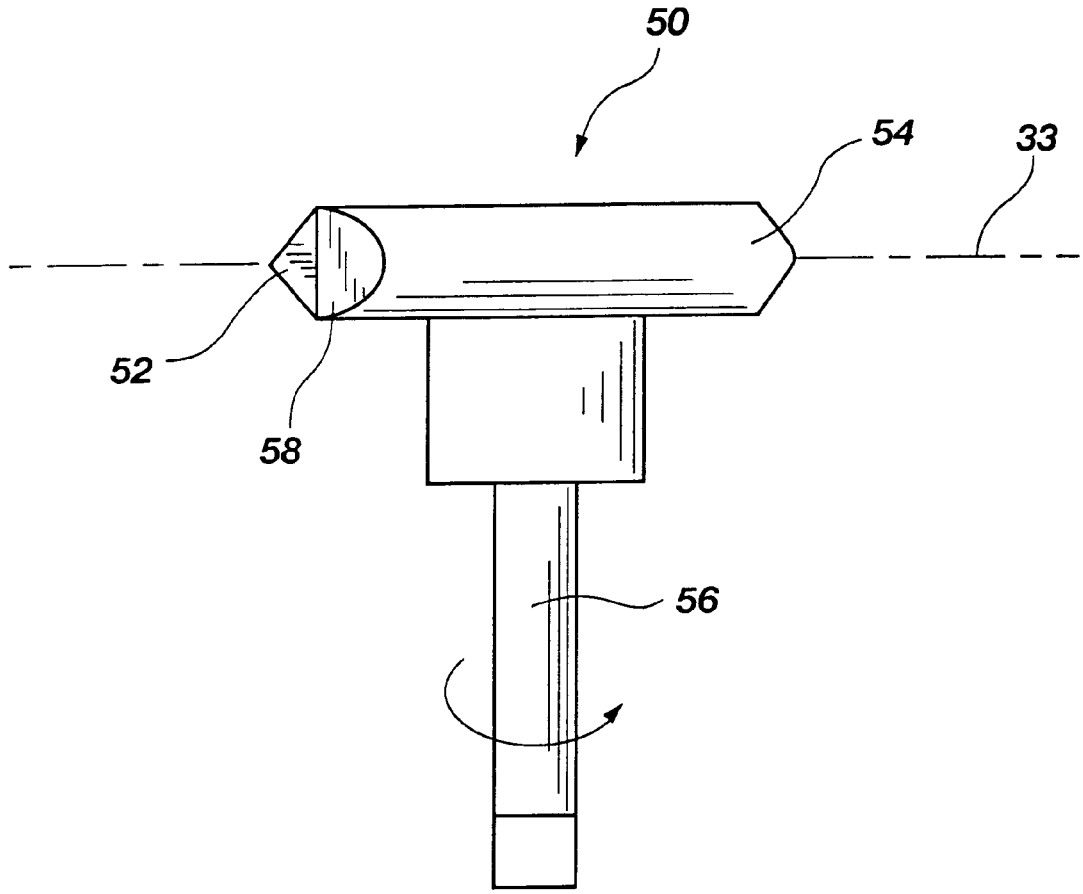
FIG. 12 is a side view of an engraving tool used to engrave an edge of a cooling fin in accordance with the preferred embodiment of the present invention.

The engraving of edge surface 32 is preferably accomplished using a hand-held, rotating diamond head cutter (not shown). Excellent results have in particular been obtained using the following equipment: a Foredom(® Micro Model FM 1000 engraver; a Foredom® Handpiece Model 0183; a Diamond flywheel in any of the following sizes: 120, 125, 130, 135, 140, 145, 150, 155, 160, 165, and 180; and a Diamond cutting member, size 3 mm. The diamond cutting member is also referred to as a burr and an exemplary cutting member 50 having a diamond cutting element 52 mounted on the periphery of a head 54 attached to a stem, or shaft, 56 is shown in FIG. 12 of the drawings. The burr preferably exhibits a 120 degree "V" shape or profile as viewed in FIG. 12. Cutting member 50 upon being installed in a handpiece capable of rotating the cutting member at a rotational speed typically exceeding 10,000 rpm is used to engrave the edge of a cooling fin to create the preferred vertically stacked rows of elongated concavities being angled (e.g. acutely angled) with respect to the horizontal axis 33 of surface edge 32. Contiguous, or abutting cuts or incisions are made into surface edge 32 and the center of each engraving is deeper than the ends of the engraving which are located proximate the edges of the fin, i.e. the depth of the engraving diminishes from the center of the engraving as it tapers off to the edge of the fin. Thus, a small part of the original edge of the fin will often remain. The axis 33 of the cutting member is preferably placed at an angle of 45 degrees with respect to the horizontal axis of cooling fin 18, but may be placed an any angle when actually engraving each intagliated portion 40. Chamfer 58 shown positioned adjacent diamond cutting element 52 is to ensure diamond cutting element 52 has plenty of approach clearance when engaging edge surfaces of cooling fins when engraving is being conducted.

There are many alternative methods that may be employed to create a surface edge on a cooling fin to have the desired characteristics of the present invention as described above. Namely, a multi-axis computer numerically controlled machining center, also referred to as a CNC machine, may be programmed to create the preferred intagliated surface edge to a depth ranging upward of 3 mm, or to any other suitable depth. Additionally, the fins of the engine component may be cast so as to be provided with an intagliated surface edge and the surface edge being polished, chemically etched, shot peened, or subjected to any suitable surface treatment known within the art to provide a desired level surface finish, or brightness. Moreover, other machines and surface forming and modifying techniques known within the art may also be employed to provide edge surfaces to cooling fins in accordance with the present invention.

Figure 13:
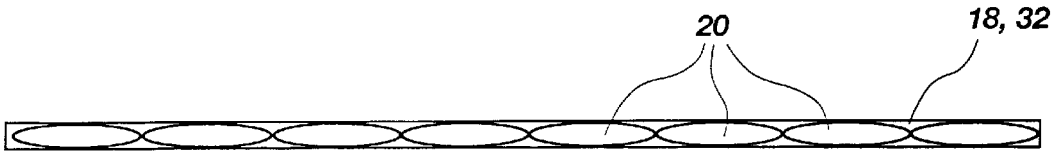
FIG. 13 is a front view of an end-to-end oval intagliated design using the method of the present invention, located on an exterior engine component.
Figure 14:
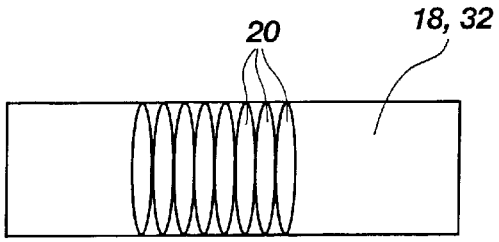
FIG. 14 is a front view of a side-by-side vertical design using the method of the present invention, located on an exterior engine component.
Figure 15:
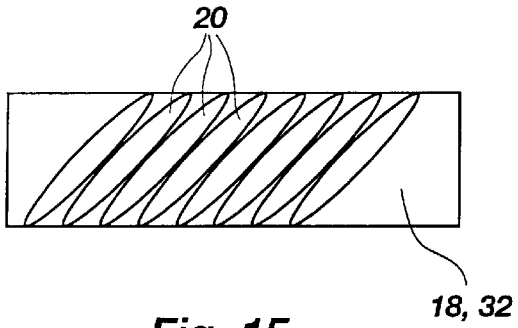
FIG. 15 is a front view of an angled, side-by-side oval design using the method of the present invention, located on an exterior engine component, located on an exterior engine component.
Figure 16:
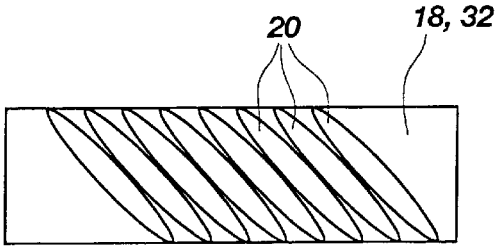
FIG. 16 is a front view of a second angled, side-by-side oval design using the method of the present invention, located on an exterior engine component.
Figure 17:
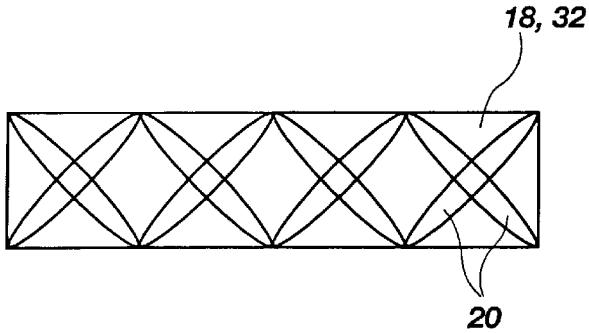
FIG. 17 is a front view of a design comprising a plurality of x-shaped combination of pairs of oval shapes using the method of the present invention, located on an exterior engine component.
Figure 18:
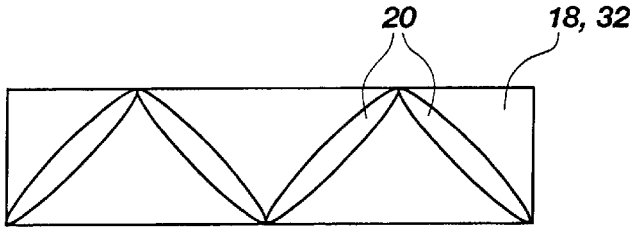
FIG. 18 is a front view of a design comprising a plurality of v-shaped combinations of pairs of oval shapes using the method of the present invention, located on an exterior engine component.
Figure 19:
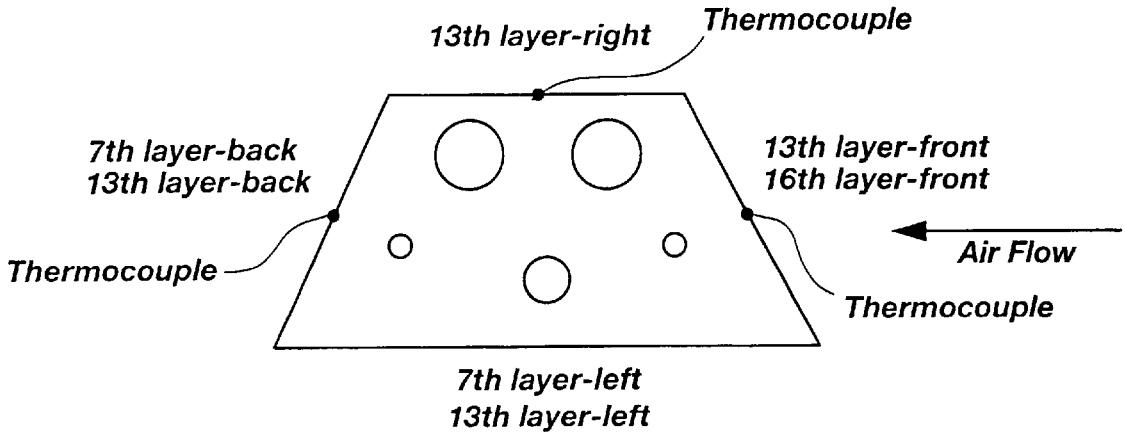
FIG. 19 is schematic view depicting the layout of the test examples described herein.

Other possible embodiments of the engraving are shown in FIGS. 13–18. FIG. 13 shows a combination of ovals 20 that are essentially in the shape of a Marquis-style diamond, that are cut into surface edge of a fin. Thus, FIG. 13 shows an end-to-end (or horizontal) combination of ovals 20, FIG. 14 shows a side-by-side (or vertical) combination of ovals 20, FIG. 15 shows an angled, side-by-side (or vertical right angled) combination of ovals 20; FIG. 16 shows an angled, side-by-side (or vertical left angled) combination of ovals 20; FIG. 17 shows a plurality of x-shaped combinations of ovals 20; and FIG. 18 shows a plurality of inverted v-shaped combinations of ovals 20. Any combination of the designs shown in FIGS. 13–18 may be employed on a particular component of an engine 12 or on different components of the engine 12.

As is the practice in the art, engines and related components are often painted or coated with a variety of materials to render the engine, or portions thereof, and related components a preselected color such as flat black. If desired, edge surfaces having intagliated portions in accordance with the present invention, may likewise be painted or coated the same, or even a different color than the remaining portion of the cooling fin and/or a channel therebetween. In the preferred embodiment, edge surfaces incorporating intagliated portions in accordance with the present invention are, for the most part, left unaltered after being engraved, at least when the cooling fin is made of a material comprising aluminum. Thus, the resulting finish of the intagliated edge surface is typically quite bright, or brilliant, when exposed to light. If desired, the intagliated edge surface may be further polished, or chemically treated to maintain, or provide an even brighter surface finish if such is desired.

EXAMPLE

A cylinder, having an individual displacement of 670 cc, and an attached cylinder head of a V-twin motorcycle engine having a total displacement of 1340 cc was tested. The upright edges of the cylinder as well as the upright edges of the cylinder head exhibited were configured according to the preferred embodiment of the instant invention as shown in FIGS. 19–24, i.e. the upright edges were engraved to define a plurality of elongate concavities. Each of the concavities was oriented with its longitudinal axis at an acute angle to the longitudinal axis of the surface of the edge. The edges were fitted with Omega K-type thermocouples. The thermocouples were attached to the edges with high thermal conductive adhesive. The thermocouples were attached to the $7^{th}$ fin and the $13^{th}$ fin at mid span on the rear of the cylinder and cylinder head arrangement. A thermocouple was also attached to the $13^{th}$ fin on the right side of the arrangement, in a central region of the right side. On the left side of the arrangement, thermocouples were attached on the $7^{th}$ and the $13^{th}$ fin, again in a central region of that side. The front of the cylinder and cylinder head arrangement was fitted on the $13^{th}$ and $16^{th}$ fin with thermocouples. The thermocouples which were attached to the front of the cylinder and cylinder head arrangement were also attached at a central region of each respective fin. The placement of the thermocouples is shown more throughly in FIG. 19.

The thermocouples were connected to a National Instrument SLSI 1000 series data acquisition module, with a 1300 model being used in this test. The data acquisition module was in turn connected to a data acquisition board NN 016 model which in turn was connected to a desktop computer, with a Gateway PC being used in this test.

A conventional cylinder with attached cylinder head of a 670 cc motorcycle having fins with smooth edge surfaces was also tested to provide a control example for purposes of assessing any differences in the performance characteristics of the inventive cylinder and cylinder head arrangement. The thermocouple arrangement of the conventional cylinder and cylinder head arrangement paralleled that of the inventive cylinder and cylinder head arrangement described above.

In a first test, the two cylinder and cylinder head arrangements were each heated to a temperature of 200 degrees Celsius. Thereafter the two arrangements were permitted to cool. No externally generated airflow was induced over the surfaces of the two cylinder and cylinder head arrangements in this first test. Temperature readings were taken by means of the various thermocouples at intervals of 4 seconds. The results of these first tests are shown graphically in FIGS. 20 and 21.

Figure 20:
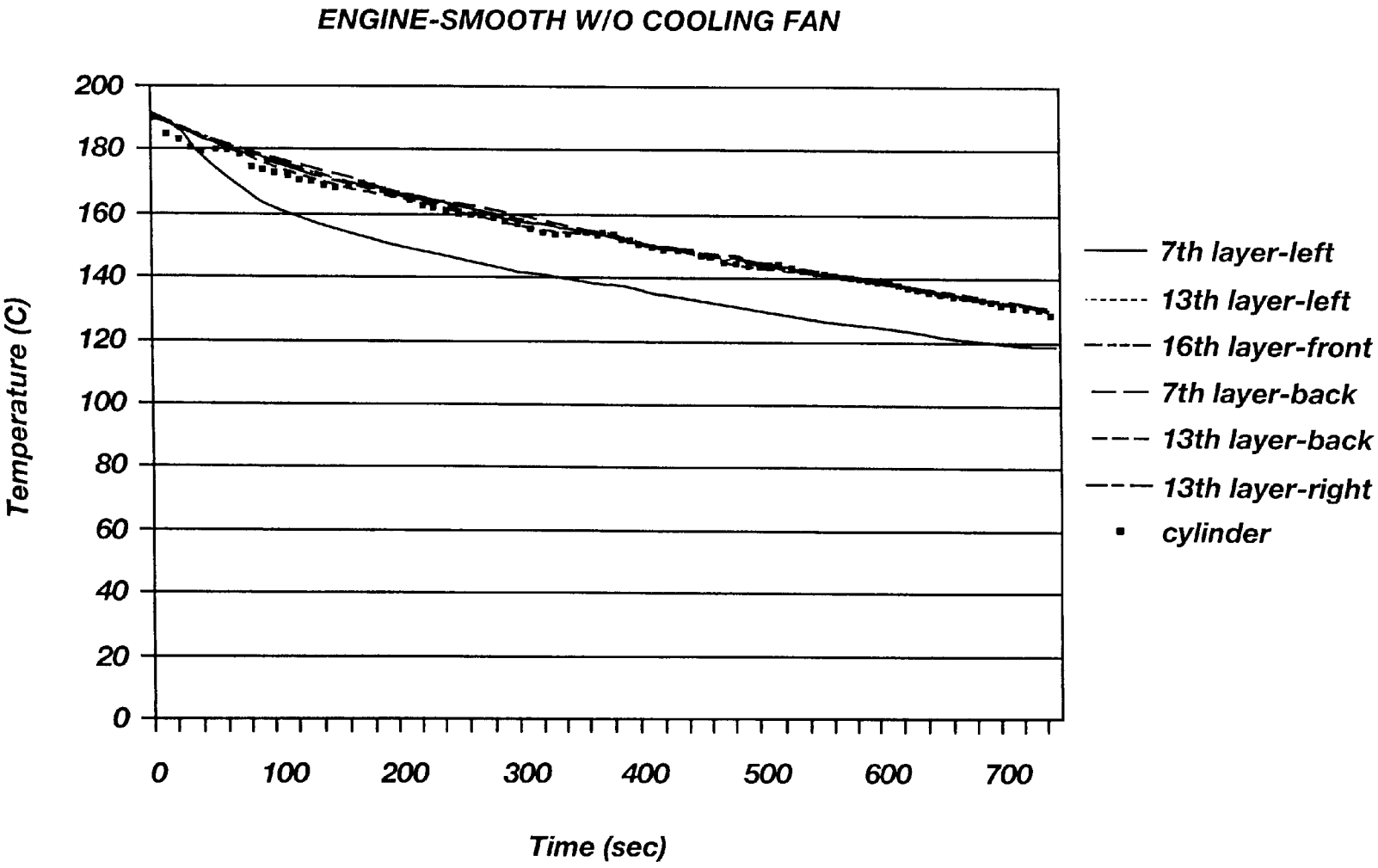
FIGS. 20–24 are testing results depicted in graphical form of the test examples described herein.
Figure 21:
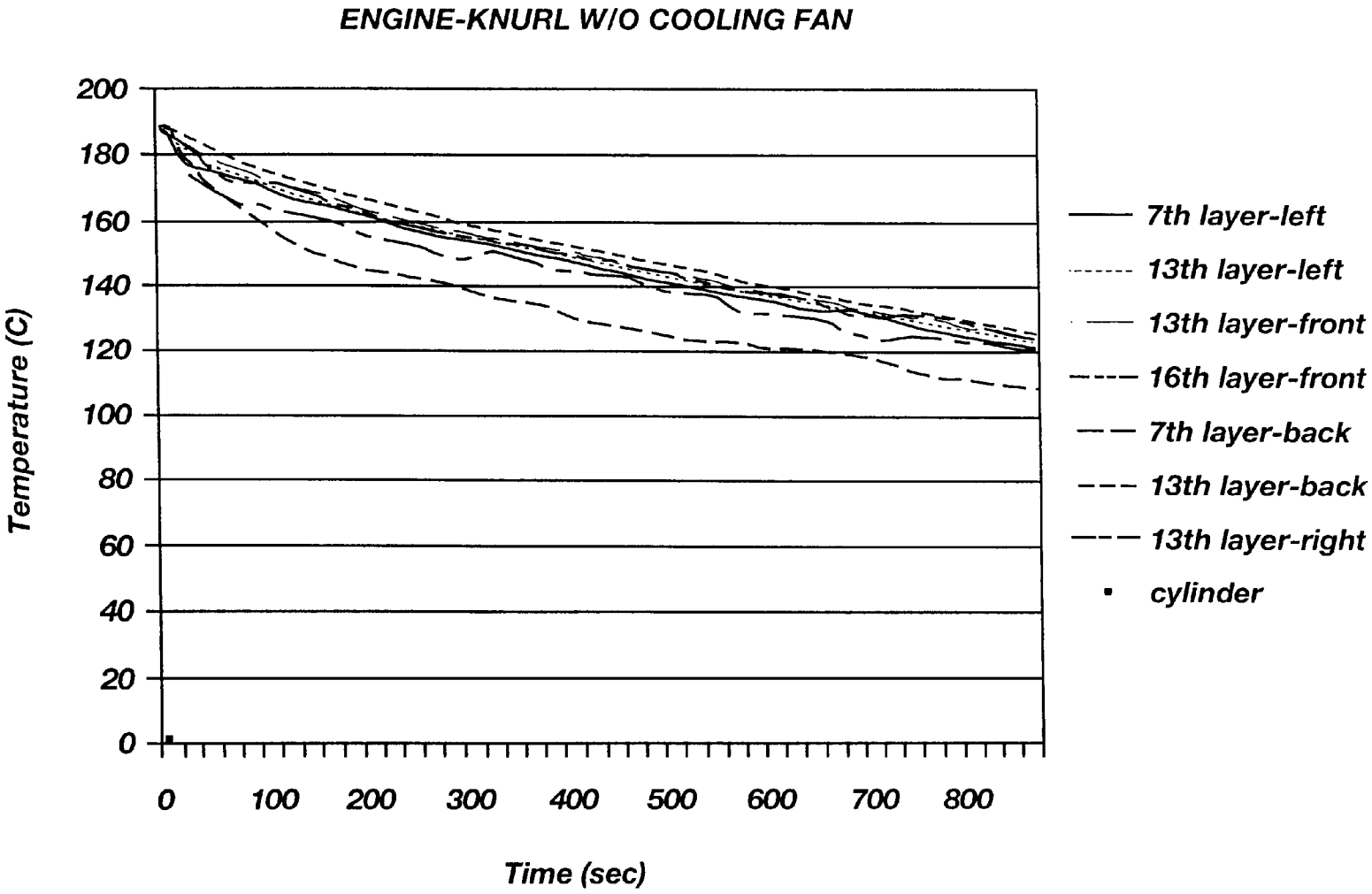

FIG. 20 illustrates the rate of cooling of the various fins of the conventional control cylinder and cylinder head arrangement. FIG. 21 illustrates the corresponding rate of cooling of the various fins of the inventive cylinder and cylinder head arrangement. A comparison of the two graphs indicates that the respective rates of cooling for the two arrangements were substantially similar to one another. This result is not unexpected. The increase in effective surface area which resulted from the engraving of the fin edge surfaces was not significantly large in comparison to the total effective surface area of the fins. The increase in effective surface area was not large enough to create an expectation of a significant increase in the rate of heat transfer from the inventive fins.

Figure 22:
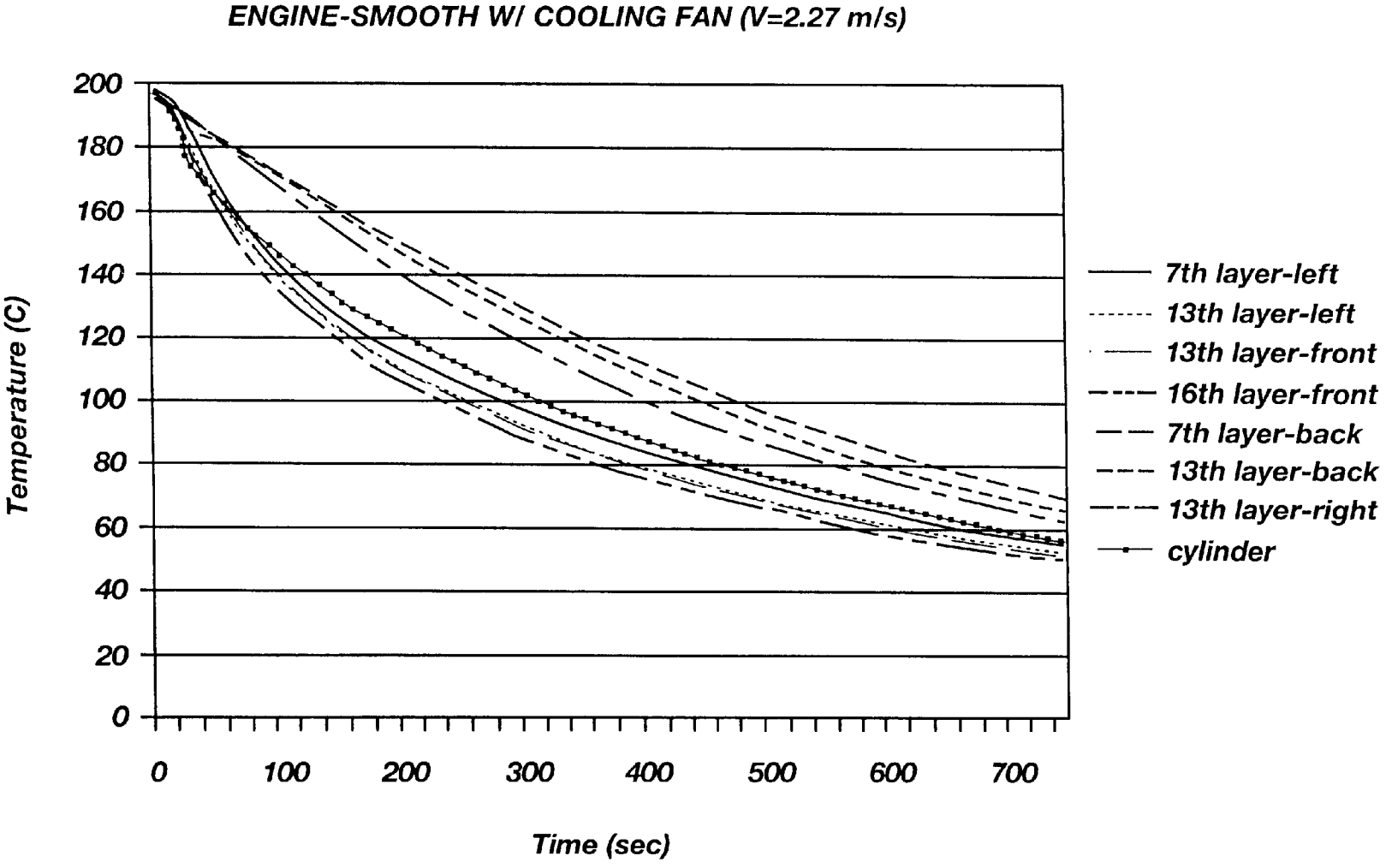
Figure 23:
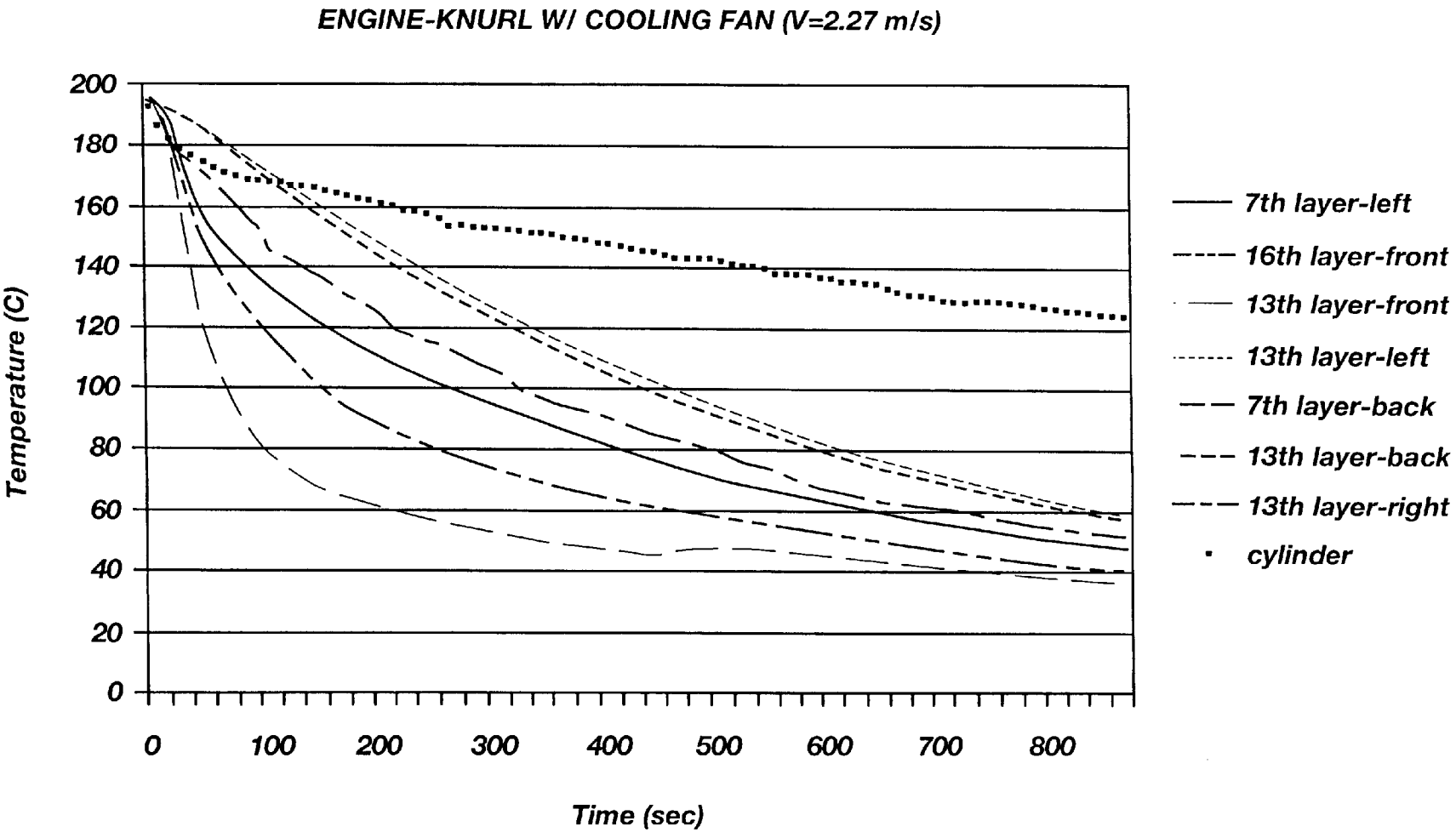
Figure 24:
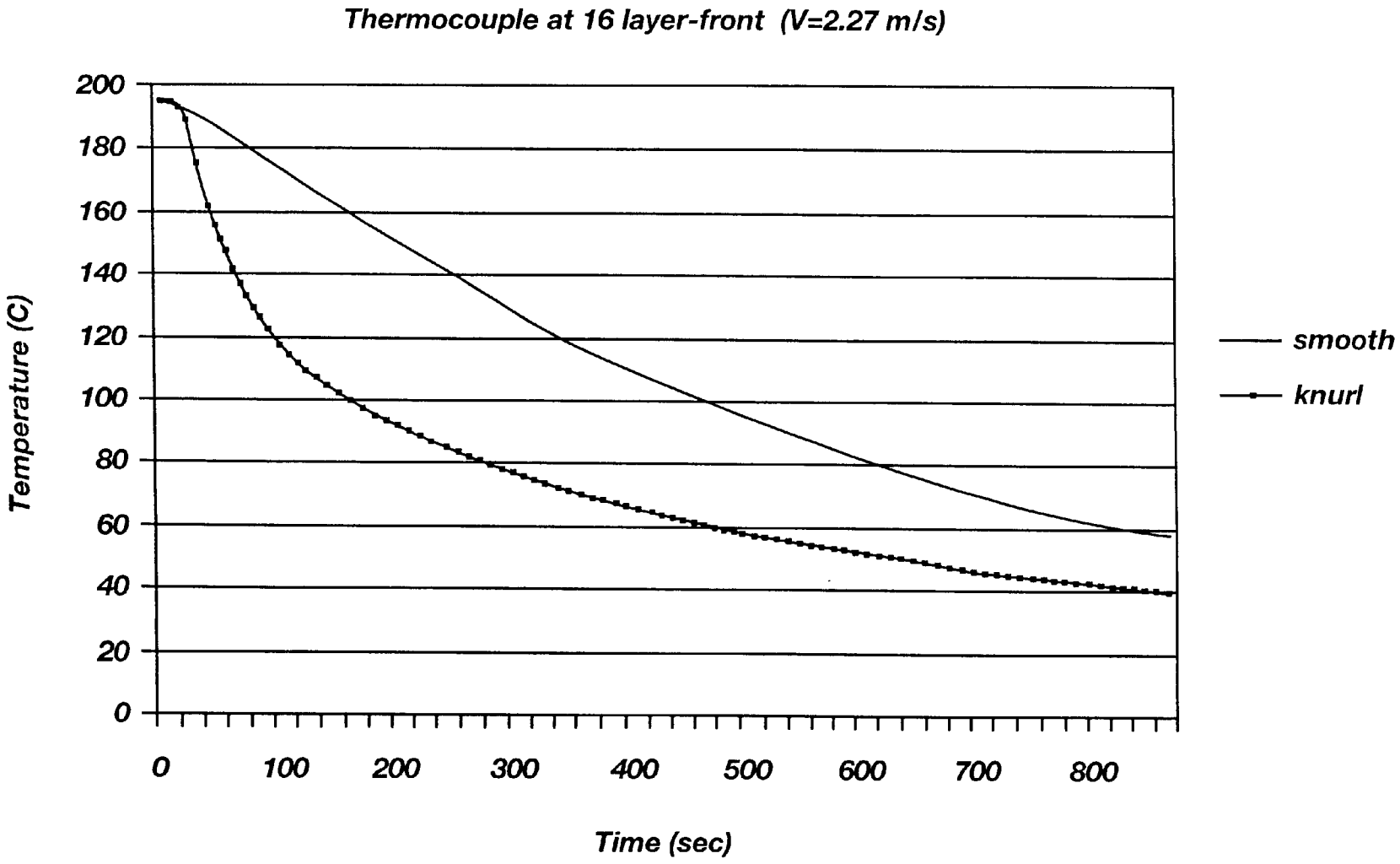

In a second test, the same two cylinder and cylinder head arrangements were again heated to a temperature of 200 degrees Celsius. Thereafter, the two arrangements were placed in the air flow path of a cooling fan. The velocity of the air flow was measured as 2.27 meters per second. Readings were then taken from the various thermocouples at intervals of four seconds. The results of this second test are shown in the graphs of FIGS. 22. and 23. FIG. 22 illustrates the results of the conventional control ("smooth") arrangement while FIG. 23 illustrates the results of the inventive ("knurl") arrangement. As may be noted from a comparison of the two graphs, the heat transfer rate of the front fins was significantly higher for the fins of the inventive arrangement in comparison to the heat transfer of the control front fins. According to the information provided in FIGS. 22 and 23, the $13^{th}$ layer front fin of the conventional control arrangement required 600 seconds to cool from 200 degrees Celsius to 60 degrees Celsius. In contrast, the $13^{th}$ layer front fin of the inventive arrangement required only 220 seconds to cool to the same temperature. It follows that the inventive arrangement achieved a temperature of 60 degrees Celsius in approximately one third of the time required by the conventional control arrangement. Furthermore, the inventive fin configuration obtained an average rate of temperature decrease of 1.16 degrees (F.) per second over the first 100 seconds of operation as compared to 0.58 degrees (F.) per second for the control fin. The inventive fin therefore had a rate of temperature decrease which was twice that of the control fin for the first 100 seconds of operation.

Turning to the test results for the $16^{th}$ layer front fin, the control arrangement achieved a reading of 60 degrees C. after 860 seconds, while the $16^{th}$ layer front fin of the inventive arrangement obtained this temperature after only 590 seconds. It follows that the inventive $16^{th}$ layer front fin obtained the same temperature reading of the control fin in approximately two thirds of the time required by the control arrangement. The fins as numbered in the test were numbered from top to bottom. Thus layer I is the uppermost fin of the cylinder head of the tested cylinder head/cylinder assemblies and layer 16 is the bottommost fin of the underlying cylinder of the tested cylinder head/cylinder assemblies. A comparison of the temperature readings of the $16^{th}$ layer control fin and the corresponding $16^{th}$ layer inventive fin are shown more clearly in FIG. 24.

Recognizing that the rate of heat transfer is directly dependent on temperature one can verify that the inventive arrangement achieves a significantly higher heat transfer rate than the conventional fin construction known in the art.

While the invention has been particularly shown and described with reference to preferred and alternative embodiments thereof, it will be understood by those skilled in the art that the foregoing and other changes in form and details may be made therein without departing from the spirit and scope of the invention as claimed.

What is claimed is:

1. An engine component comprising:

at least one thermally conductive cooling fin structure, the cooling fin structure including a first surface, an oppositely facing second surface, and an edge surface in communication with the first surface and the second surface; and at least a portion of the edge surface of the fin structure including at least one intagliated region comprising at least two concavities of a preselected configuration therein, said edge surface defining a longitudinal axis and one of said concavities defining a longitudinal axis, said longitudinal axis of said one of said concavities being oriented at an angle to said longitudinal axis of said edge surface.

2. The engine component of claim 1, wherein at least one of the concavities is an elongated concavity.

3. The engine component of claim 1, wherein at least one intagliated region comprises at least one first, upper elongated concavity and at least one second, lower elongated concavity.

4. The engine component of claim 3, wherein at least one of said concavities defines a central region and at least one end region, said central region having a depth, as determined from said edge surface, which is dimensionally larger than a depth defined by said end region as determined from said edge surface.

5. The engine component of claim 1, further comprising:

a majority of the edge surface of the fin structure defines concavities therein.

6. The engine component of claim 1, wherein the engine component is selected from the group consisting of a engine casing, a cylinder, a cylinder head, an engine component cover, a rocker arm cover, a cam cover, an inspection cover, an access cover, an oil cooler, a tube and shell heat exchanger.

7. The engine component of claim 1, wherein said longitudinal axis of said one of said concavities being oriented at an angle to said longitudinal axis of said edge surface comprises said longitudinal axis of said one of said concavities being oriented at an acute angle to said longitudinal axis of said edge surface.

8. The engine component of claim 1 wherein said engine component is selected from the group consisting of aluminum, aluminum based alloy, iron, titanium, tungsten and steel.

9. An engine component comprising:

at least one thermally conductive cooling fin structure, the cooling fin structure including a first surface, an oppositely facing second surface, and an edge surface in communication with the first surface and the second surface; and at least a portion of the edge surface of the fin structure including at least one intagliated region, such that an intersection of said first surface and said edge surface defines a scalloped configuration.

10. The engine component of claim 9 wherein said component is selected from the following group consisting of a cylinder, cover, cooler, plate and head.

11. The engine component of claim 9 wherein said component is selected from the following group consisting of aluminum, aluminum based alloy, iron, titanium, tungsten or steel.

12. A method of producing an irregular surface on a engine component comprising:

providing a vehicle engine having a least one exposed component;

providing a plurality of fins on said engine component; and engraving a portion of an edge of said fin on said engine component with an engraving tool to define a plurality of elongate concavities within a surface of said edge, wherein each said concavity defines a longitudinal axis and said longitudinal axes are oriented parallel to one another, such that said portion of an edged of said fin defines a sculpted surface, a multi-faceted surface, a scalloped surface, a concave surface, an overlapping structural relief, a relieved surface, a cut surface, a rounded surface, a fluted surface, a pattern of inequalities or a textured surface.

13. The method according to claim 12 wherein said component is selected from the following group consisting of a cylinder, cover, cooler, plate and head.

14. The method according to claim 12 wherein said engine component is selected from the following group consisting of aluminum, aluminum based alloy, iron, titanium, tungsten or steel.

* * * * *